US005462304A

United States Patent [19]

Nyman

[11] Patent Number: 5,462,304

[45] Date of Patent: Oct. 31, 1995

[54] SNOWBOARD WITH DUAL-ACTING, INTERCHANGEABLE EDGES

[76] Inventor: Bengt E. Nyman, 4025 Carmel View Rd. #132, San Diego, Calif. 92130

[21] Appl. No.: 142,824

[22] Filed: Oct. 25, 1993

[51] Int. Cl.[6] ..... A63C 5/04

[52] U.S. Cl. ..... 280/609; 280/14.2

[58] Field of Search ..... 280/601, 608, 280/609, 14.2

[56] References Cited

U.S. PATENT DOCUMENTS

| | | | |
|---|---|---|---|
| 3,304,095 | 2/1967 | Carlton | 280/11.13 |
| 3,395,411 | 8/1968 | Pope, Jr. | 9/310 |
| 3,428,979 | 2/1969 | Johnson | 9/310 |
| 3,774,254 | 11/1973 | Meyer | 9/310 A |
| 3,814,417 | 6/1974 | Catlin | 272/56.5 SS |
| 4,083,577 | 4/1978 | Ford | 280/608 |
| 4,524,984 | 6/1985 | Axelson | 280/608 |
| 4,951,960 | 8/1990 | Sadler | 280/607 |
| 4,974,868 | 12/1990 | Morris | 280/609 |
| 5,018,760 | 5/1991 | Remondet | 280/609 |

*Primary Examiner*—Richard M. Camby

[57] ABSTRACT

An improved snowboard having a pair of dual-acting, interchangeable edges. Each dual-acting edge incorporates one inside, inward-facing edge and one elevated outside edge. The inside, inward-facing edges provide stable control of the snowboard while riding it flat on the snow. One of the elevated outside edges is brought into contact with the snow when the snowboard is tilted off its bottom surface and up onto the outside edge for increased carving and turning power.

6 Claims, 3 Drawing Sheets

SNOWBOARD WITH DUAL-ACTING, INTERCHANGEABLE EDGES

TECHNICAL FIELD

This invention relates to snowboards for carrying one or more riders on snow, and more specifically to a snowboard having dual-acting, interchangeable edges incorporating inside, inward-facing edges and elevated outside edges for improved stability and control.

BACKGROUND OF THE INVENTION

A snowboard consists of a curved-up nose, a tail, a top, a flat bottom, and two longitudinally concave outside edges. Unlike a ski or a toboggan, a snowboard cannot be ridden flat on its bottom surface. When ridden flat, there is a strong tendency for the downhill edge to catch the snow, causing the rider to lose control. A snowboard is always tipped up on its uphill edge and balanced on that edge. The angle of tilt of the snowboard and a forward-rearward shift of the weight of the rider is used to control the snowboard. The turning characteristics of a snowboard are associated with the shape of the outside edge. The longitudinally concave shape of the edge forms a line of contact with the snow describing an arc. This arc guides the snowboard and its rider through a sweeping turn. The more the snowboard is tipped up on one of its concave outside edges, the tighter the turn.

One of the problems with a snowboard involves changing from riding on one edge to riding on the opposite edge. During this transition the snowboard is flat on its bottom surface, and both outside edges are contacting the snow. If this transition is not expertly timed, the downhill edge of the snowboard can catch the snow, causing loss of control and, possibly, a fall.

Another problem with a snowboard occurs when trying to run straight down a gentle hill on the flat bottom surface of the snowboard. In this situation both outside edges are contacting the snow, and the curvature of the left edge is suggesting a left turn, while the curvature of the right edge is suggesting a right turn. The slightest undulation in the terrain will tip the force balance in favor of one of the edges, unexpectedly turning the snowboard out from under the rider, causing the rider to fall.

In summary, a snowboard is unstable while on its flat bottom surface. A snowboard requires the strength and agility of the rider to balance it on one of its edges at all times. Expert judgment and timing in shifting edges while turning is critical. Snowboards cannot be ridden straight downhill. Because of the instability and consequent unpredictability of a snowboard, the learning process can be surprising, unpleasant, frustrating and sometimes even injurious.

To make snowboarding easier to learn and more enjoyable, several improvements over a conventional snowboard have been attempted. For example, in U.S. Pat. No. 4,974,868 to Morris (1990) the main improvement claimed is a convex bottom to "facilitate rapid changing between edges" and one or several perpendicular channels formed in the bottom of the snowboard to "allow snow to escape from under the snowboard". However, Morris does not address the issue of instability caused by the downhill edge catching the snow. In the Morris invention this problem is actually made worse, because the sides project beyond the bottom of the snowboard.

In U.S. Pat. No. 5,018,760 to Remondet (1991) the main feature claimed is an asymmetry of the snowboard for the purpose of equalizing left and right turning characteristics and a second set of inside edges provided to "reduce the push required to engage an edge." Unfortunately, the second set of outward-facing edges accentuates the instability of the Remondet snowboard.

In U.S. Pat. No. 4,083,577 to Ford (1976) the main feature is a convex cross-section of the running surface and a pair of elongated blades reaching down toward the lowest point of the convex running surface. In the Ford invention the convex cross-section of the running surface forms a rocker which in combination with the generous downward extension of the claw-like blades accentuate the probability of accidentally causing the downhill edge to catch the snow. Due to the inherent sharpness of the blade it penetrates and catches the snow, causing loss of control, in spite of the radius provided on the outside corner of the blade.

In all three cases, and in all other patents and designs which I have studied, I have not found any measurable attempt to understand or improve the stability of a snowboard while riding on its central bottom surface.

OBJECTS AND ADVANTAGES

The purpose of this invention is to describe the design of a stable and predictable snowboard with the following objects and advantages:

(a) to provide a snowboard which is safe and easy to learn and comfortable and fun to ride, (b) to provide a snowboard which exhibits stable and predictable characteristics throughout its entire range of operation and through its entire range of tilt, including while traveling on its bottom surface, while traveling in a straight line and while traveling straight downhill, (c) to provide a snowboard where the edges are easily detachable for the purpose of facilitating sharpening, repair and replacement of the edges, (d) to provide a snowboard with interchangeable edges for use of different edges under different conditions such as on powder snow, packed snow, and ice; and for different purposes such as downhill, slalom, and free style.

BRIEF DESCRIPTION OF THE DRAWINGS

The foregoing description of the present invention may be more readily understood by viewing the following drawings in conjunction with the further description below, wherein.

REFERENCE NUMERALS IN DRAWINGS

10 Nose

11 Tail

12 Left outside edge

13 Right outside edge

14 Center bottom surface

15 Left relief surface

16 Right relief surface

17 Left inside edge

18 Right inside edge

19 Left side surface

20 Right side surface

21 Left interchangeable edge strip

22 Right interchangeable edge strip

23 Arrow depicting force of snow acting on side of snowboard

DETAILED DESCRIPTION OF THE INVENTION

Detailed description of the figures

Figure 1:
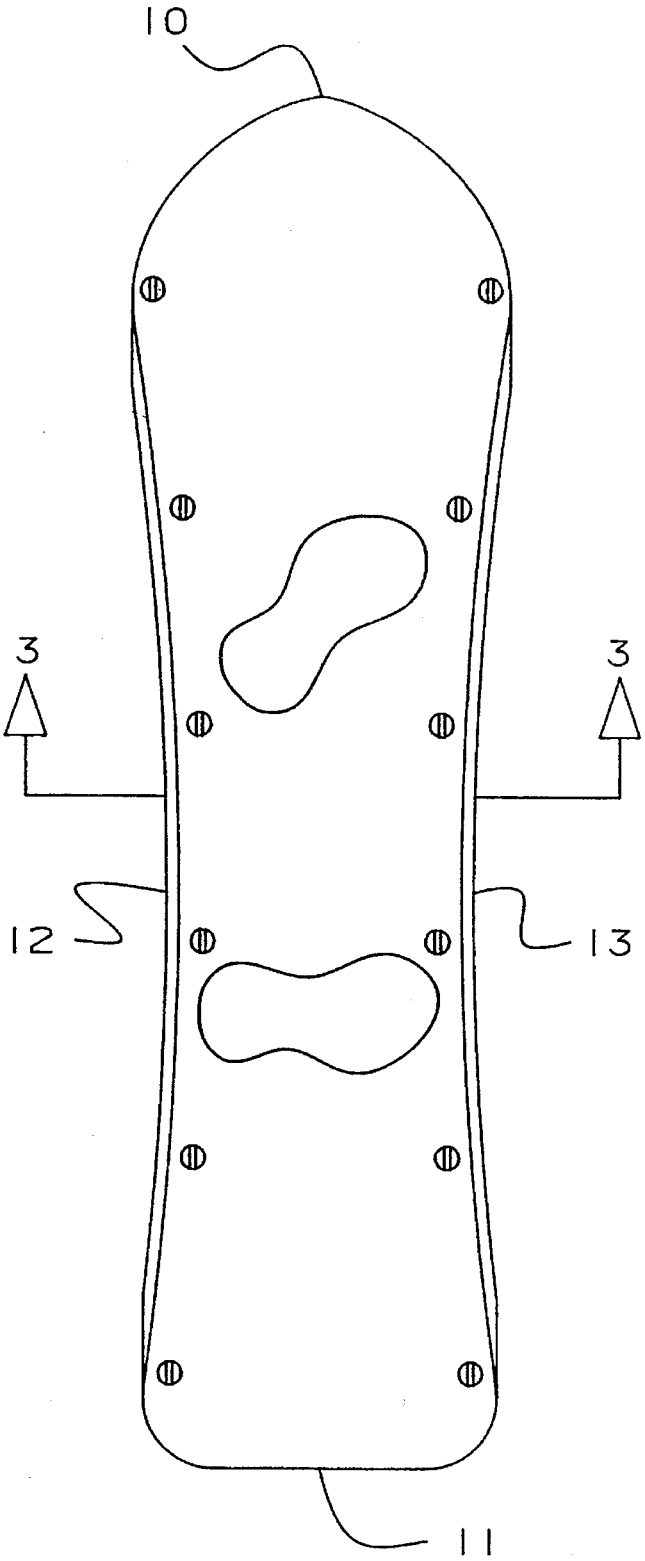
FIG. 1 is a top view of a snowboard formed in accordance with the present invention.

The snowboard of the present invention is illustrated in FIG. 1 and consists of a curved-up nose 10, a tail 11, a left outside edge 12, and a right outside edge 13.

Figure 2:
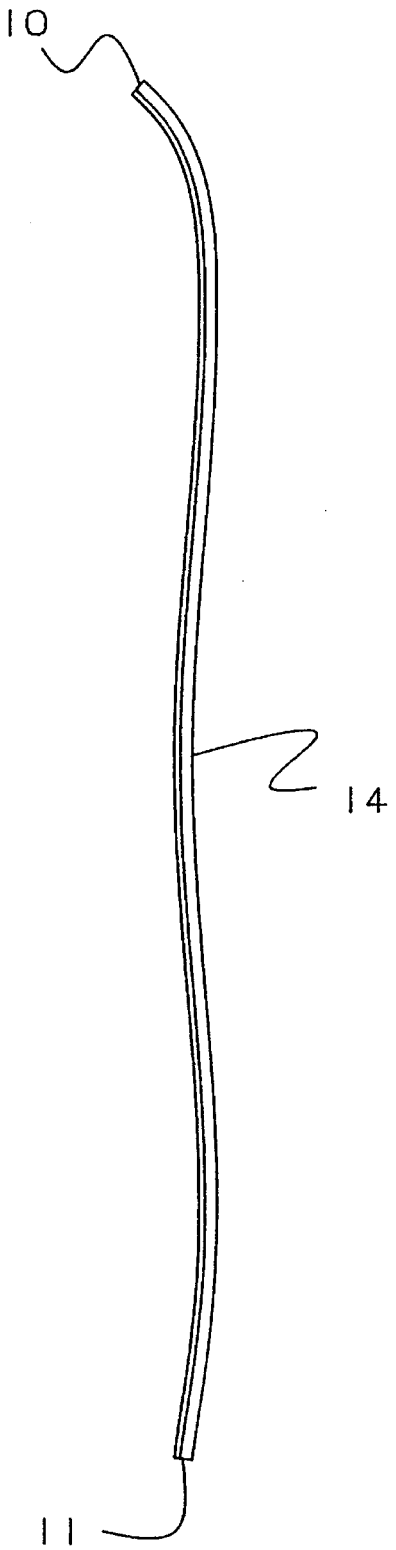
FIG. 2 is a side view of the snowboard of FIG. 1.

FIG. 2 shows a side view of the snowboard of FIG. 1 including its center bottom surface 14.

Figure 3A:
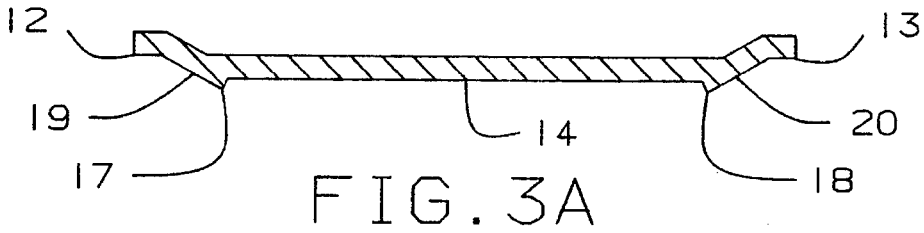
FIG. 3A is a cross section end view of one embodiment of a snowboard formed in accordance with the present invention.

FIG. 3A shows a cross section end view of one embodiment of the present invention. The center bottom surface 14 extends to two inside, inward-facing edge surfaces 17 and 18. The surfaces 17 and 18 extend down and slightly out. Two side surfaces 19 and 20 extend out and up from the bottom of the edge surfaces 17 and 18. The side surfaces 19 and 20 may curve to become approximately horizontal before they reach the outside edges 12 and 13 respectively. Due to the outward and upward extension of the side surfaces 19 and 20, the outside edges 12 and 13 are elevated above the snow and are not in contact with the snow when the snowboard rests with the bottom surface 14 flat on the snow.

Figure 3B:
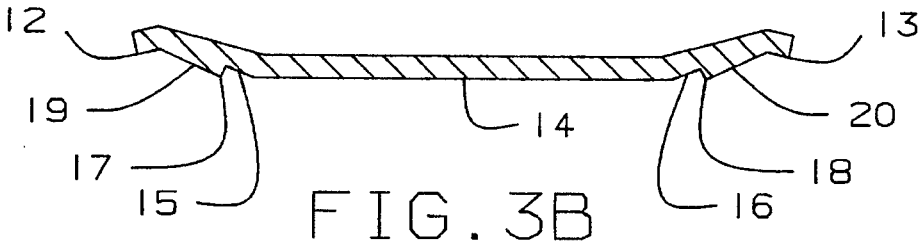
FIG. 3B is a cross section end view of an alternative embodiment of a snowboard formed in accordance with the present invention.

FIG. 3B shows a cross section end view of an alternative embodiment of the present invention where the center bottom surface 14 terminates in two relief surfaces 15 and 16. The relief surfaces 15 and 16 point out and slightly up and extend to the inside, inward-facing edge surfaces 17 and 18. The inside, inward-facing edge surfaces 17 and 18 extend from the outside of the relief surfaces 15 and 16 and reach down toward the snow and slightly out. The two side surfaces 19 and 20 extend out and up from the bottom of the edge surfaces 17 and 18. The two side surfaces 19 and 20 initially extend out and up and then curve into a gull-wing shape, pointing out and down before they reach the outside edges 12 and 13 respectively. The outside edges 12 and 13 are elevated above the snow and are not in contact with the snow when the snowboard rests with the bottom surface 14 flat on the snow. The gull-wing shape of the two side surfaces 19 and 20 tilts the outside edges 12 and 13 downward to increase the edge effect of the outside edges once they contact the snow.

Figure 3C:
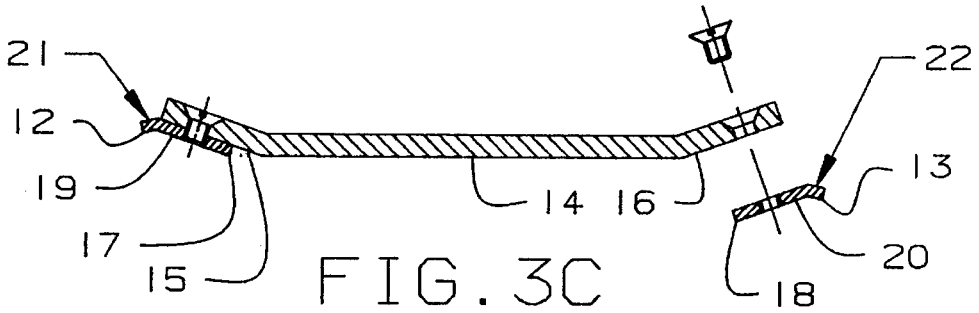
FIG. 3C is a cross section end view of the preferred embodiment of a snowboard formed in accordance with the present invention.

FIG. 3C shows a cross section end view of the preferred embodiment of the present invention which, in addition to being formed in accordance with the geometry of FIG. 3B, features a pair of detachable, replaceable, interchangeable, dual-acting edge strips 21 and 22. The left dual-acting edge strip 21 incorporates the inside, inward-facing edge 17 and the gull-wing-shaped outside edge 12. The right dual-acting edge strip 22 incorporates the inside, inward-facing edge 18 and the gull-wing-shaped outside edge 13.

Figure 3D:
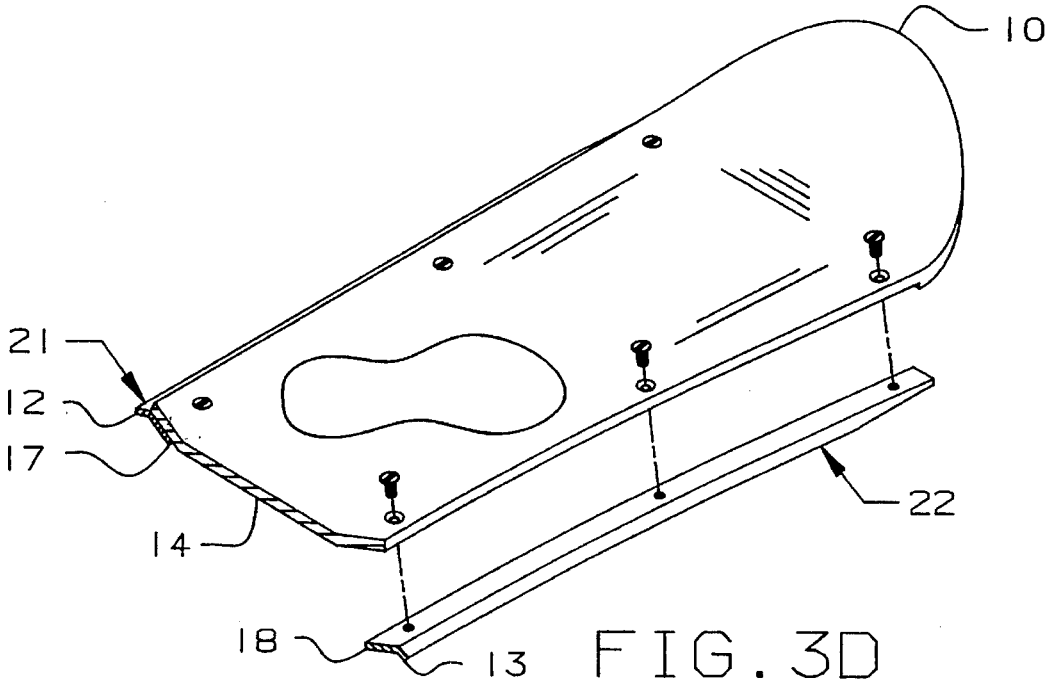
FIG. 3D is an isometric cross section end view of the snowboard of FIG. 3C.

FIG. 3D shows an isometric cross section end view of the preferred embodiment of the invention of FIG. 3C.

Figure 4A:
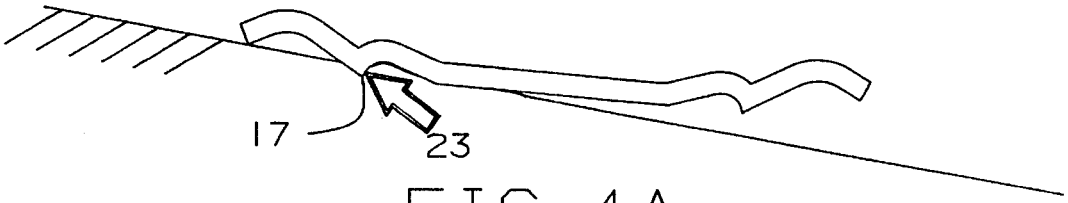
FIG. 4A is an end view of one embodiment of a snowboard formed in accordance with the present invention and an illustration of the sideways force acting on the snowboard while it is ridden on its uphill edge.

FIG. 4A shows one embodiment of the present invention ridden in a typical position with the uphill inside edge 17 carving into the snow. Arrow 23 illustrates the force of the snow acting on the inside edge 17. The size of the arrow 23 illustrates the relative size of the force.

Figure 4B:
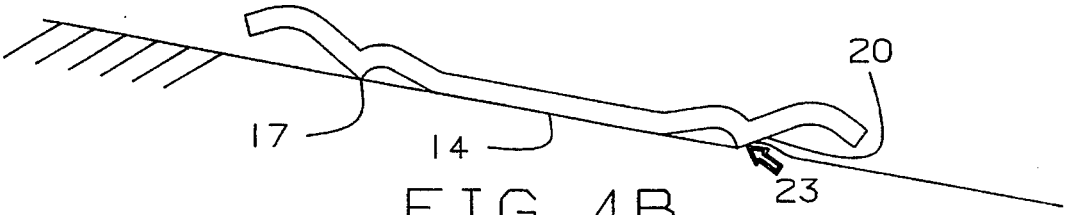
FIG. 4B is an end view of the snowboard of FIG. 4A and an illustration of the sideways force acting on the snowboard while it is ridden on its bottom surface.

FIG. 4B shows the snowboard of FIG. 4A ridden with its bottom surface 14 flat on the snow. In this position the uphill inside edge 17 is out of the snow, while the side surface 20 contacts the snow. The arrow 23 illustrates the force of the snow acting on the side surface 20. The size of the arrow 23 illustrates the relative size of the force. A comparison of FIGS. 4A and 4B shows a reduction in the sideways force 23 as the snowboard is tilted from its typical position in FIG. 4A to the flat position shown in FIG. 4B.

Figure 5A:
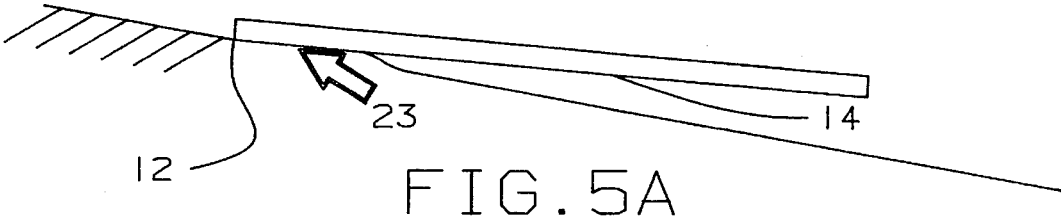
FIG. 5A is an end view of a typical, prior art snowboard and an illustration of the sideways force acting on the snowboard while it is ridden on its uphill edge.

FIG. 5A shows a prior art snowboard ridden in a typical position where a portion of the bottom surface 14 near the edge 12 is carving into the snow. The arrow 23 illustrates the force of the snow acting on the bottom surface 14 near the edge 12 of the snowboard. The size of the arrow 23 illustrates the relative size of the force.

Figure 5B:
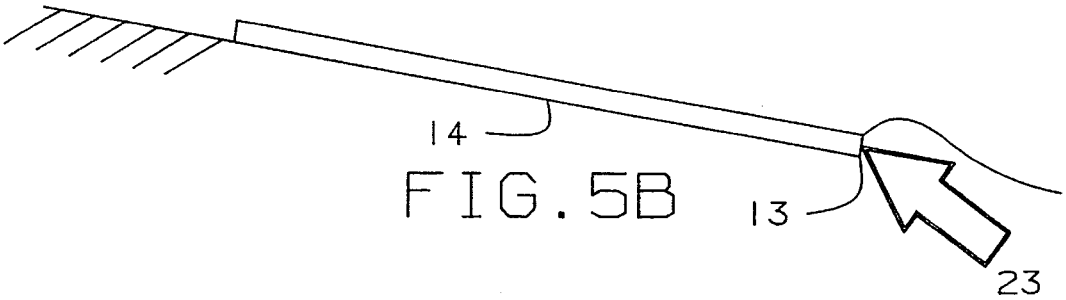
FIG. 5B is an end view of the snowboard of FIG. 5A and an illustration of the sideways force acting on the snowboard while attempting to ride the snowboard on its bottom surface.

FIG. 5B shows the prior art snowboard of FIG. 5A in an attempt to be ridden with its bottom surface 14 flat on the snow. In this position the edge effect of the bottom surface 14 near the edge 12 is lost, while the downhill outside edge 13 is in a position to catch the snow. The size of the arrow 23 illustrates the relative size of the force. A comparison of FIGS. 5A and 5B shows a dramatic increase in the sideways force 23, if the bottom surface 14 of a prior art snowboard is allowed to come in flat contact with the snow.

Operational Description

When the present invention snowboard is ridden flat on the snow, the center bottom surface 14 and the inside edges 17 and 18 are touching the snow. Due to the upward and outward angularity of the side surfaces 19 and 20, the outside edges 12 and 13 are elevated above the snow and are not in contact with the snow. Each inside edge of the present invention is designed to offer resistance to sideways movement of the snowboard across the snow in one sideways direction and to offer little or no resistance to sideways movement across the snow in the opposite direction. FIG. 4A shows a snowboard formed in accordance with the present invention and ridden in a typical position with the uphill inside edge 17 carving into the snow. The arrow 23 illustrates the force of the snow acting on the inside edge 17, resisting any undesired sideways movement of the snowboard down the hill.

FIG. 4B shows the snowboard of FIG. 4A with the bottom surface 14 lowered flat onto the snow. As the bottom surface 14 contacts the snow, the uphill inside edge 17 pulls out of the snow, while the downhill side surface 20 contacts the snow. Due to the gentle angle of the side surface 20, compared to that of the inside edge 17, the ability of the snowboard to grip the snow is reduced. As the force 23 acting on the side of the snowboard is reduced, the snowboard and the legs of the rider begins to accelerate downhill. This tips the snowboard of FIG. 4B in a counter-clockwise direction which puts the inside edge 17 back into the snow, allowing the rider to regain control and stabilize the situation.

The present invention offers stable control of the snowboard including when it is ridden on its flat bottom surface.

This contrasts sharply to prior art snowboards which tend to catch the downhill edge and become inherently unstable when ridden flat on the snow as described below;

FIG. 5A shows a prior art snowboard ridden in a typical position where a portion of the bottom surface 14 near the edge 12 is carving into the snow. The arrow 23 illustrates the force of the snow acting on the bottom surface 14 near the edge 12, resisting any undesired sideways movement of the snowboard down the hill.

FIG. 5B shows the prior art snowboard of FIG. 5A with its bottom surface 14 allowed to rest flat on the snow. As the bottom surface 14 contacts the snow, the edge effect of the bottom surface 14 near the edge 12 is lost, while the downhill outside edge 13 is in a position to catch the snow. Due to its acute angle, the outside, downhill edge 13 grips the snow with a vengeance and produces an effect called "catching an edge." The result is a dramatic increase in the force 23 acting on the side of the snowboard, which causes a sudden deceleration of any sideways motion of the snowboard. This sudden deceleration tips the snowboard of FIG. 5B in a clockwise direction, which drives the downhill edge 13 further into the snow, which further catches the edge and causes the rider to fall.

Prior art snowboards are thus inherently unstable when ridden flat on the snow.

Conclusion, Ramifications and Scope

Thus it has been made clear that the snowboard of the present invention is easier to learn and a safer, more stable, and more comfortable vehicle for carrying one or several persons on snow, than are prior art snowboards.

While the above description is detailed and specific, it should not be construed as a limitation to the spirit or scope of this invention. Consequently, the scope of this invention shall be determined not by the embodiments illustrated, but by the appended claims and their legal equivalents.

What I claim is:

1. A snowboard comprising:

a curved up nose, a top, a flat bottom, a tail, and two curved up, sawtooth shaped side surfaces, each said side surface cross-section perpendicular to the length axis of said bottom forming a curved up, sawtooth shape extending essentially the full length of the snowboard, the first of said sawtooth surfaces extending from the edge of said bottom and pointing out and up at a shallow angle from the plane of said bottom, a second sawtooth surface extending from the outside edge of said first sawtooth surface and pointing out and down at a shallow angle toward the plane of said bottom surface, said second sawtooth surface terminating at an elevation slightly above that of said bottom surface, a third sawtooth surface extending from the outside edge of said second sawtooth surface and pointing out and up at an angle to said bottom surface which is larger than that formed by said first sawtooth surface to said bottom surface, said third sawtooth surface terminating at an elevation well above that of said bottom surface, a fourth sawtooth surface extending from the outside edge of said third sawtooth surface and pointing essentially straight out and parallel to said bottom surface, said fourth sawtooth surface being elevated well above said bottom surface, a fifth and final surface pointing essentially straight up and connecting said curved up, sawtooth shaped side construction to said top of said snowboard.

2. A snowboard according to claim 1 where in a cross-section perpendicular to the length axis of said bottom, said first sawtooth surface extends out and up at an angle of 10 to 30 degrees from the plane of said bottom surface, where said second sawtooth surface extends out and down at an angle of 5 to 15 degrees to the plane of said bottom surface, where said third sawtooth surface extends out and up at an angle of 15 to 45 degrees from the plane of said bottom surface, where said fourth sawtooth surface extends essentially straight out and parallel to the plane of said bottom surface, where said fifth and final surface points up at an angle of essentially 90 degrees to the plane of said bottom surface and connects to said top surface of said snowboard.

3. A snowboard according to claim 2 where in a cross-section perpendicular to the length axis of said bottom, said first sawtooth surface extends out and up for a length of between 1/32 and 3/32 of an inch, where said second sawtooth surface extends out and down for a length of between 1/16 and 3/16 of an inch, where said third sawtooth surface extends out and up for a length of between ⅛ and ⅜ of an inch, where said fourth sawtooth surface extends essentially straight out for a length of between ¼ and ¾ of an inch.

4. A snowboard according to claim 3 where the outer-most edge of the outer-most sawtooth surface extends to between ½ and 1 inch outside the outside edge of said bottom surface, and where the upper-most edge of the outer-most sawtooth surface extends to between ¼ and ½ of an inch above the plane of said bottom surface.

5. A snowboard according to claim 4 where each said side surface is part of a separate, detachable and replaceable structural edge, the combined structural strength of said edges being a substantial part of the cross-section moment of inertia, stiffness and strength of said snowboard, whereby the snowboard would not be stiff enough nor strong enough to safely support the weight of a rider were said edges not attached to said snowboard.

6. A snowboard according to claim 5 where said edges are formed by means of extruding a strong and light-weight metal such as aluminum or titanium.

* * * * *